US009285771B2

(12) United States Patent
Moyse et al.

(10) Patent No.: US 9,285,771 B2
(45) Date of Patent: Mar. 15, 2016

(54) DRIVE MEMBER FOR CLOCK MOVEMENT

(71) Applicant: Cartier Creation Studio SA, Geneva (CH)

(72) Inventors: Romain Moyse, Montlebon (FR); Kewin Bas, Villers le Lac (FR); Dominique Perreux, Pirey (FR)

(73) Assignee: Cartier Creation Studio SA (CH)

( * ) Notice: Subject to any disclaimer, the term of this patent is extended or adjusted under 35 U.S.C. 154(b) by 0 days.

(21) Appl. No.: 14/409,644

(22) PCT Filed: Jun. 14, 2013

(86) PCT No.: PCT/EP2013/062408

§ 371 (c)(1),
(2) Date: Dec. 19, 2014

(87) PCT Pub. No.: WO2013/189856

PCT Pub. Date: Dec. 27, 2013

(65) Prior Publication Data

US 2015/0338826 A1 Nov. 26, 2015

(30) Foreign Application Priority Data

Jun. 22, 2012 (CH) ..... 883/12

(51) Int. Cl.
*G04B 1/18* (2006.01)
*G04B 1/12* (2006.01)
*G04B 1/14* (2006.01)

(52) U.S. Cl.
CPC .. *G04B 1/12* (2013.01); *G04B 1/14* (2013.01); *G04B 1/18* (2013.01); *Y10T 29/49583* (2015.01)

(58) Field of Classification Search
CPC ..... G04B 1/18; G04B 1/00; G04B 1/16; G04B 1/12; Y10T 29/49583
See application file for complete search history.

(56) References Cited

U.S. PATENT DOCUMENTS

| | | | | |
|---|---|---|---|---|
| 163,161 | A | 5/1875 | Dawson | |
| 175,371 | A * | 3/1876 | Johnson | B67C 3/24 141/278 |
| 525,265 | A * | 8/1894 | Gauthier | G04B 1/16 368/144 |
| 816,723 | A | 4/1906 | Gibson | |
| 1,223,982 | A | 4/1917 | Jordan | |
| 1,643,403 | A * | 9/1927 | Borresen | G04B 1/16 368/144 |
| 2,192,101 | A | 6/1937 | Peskin | |
| 2,552,963 | A * | 5/1951 | Hall | G04B 1/16 368/142 |
| 2,617,248 | A | 11/1952 | Brown | |
| 4,363,553 | A | 12/1982 | Thomi et al. | |
| 2010/0246339 | A1 | 9/2010 | Mertenat | |
| 2011/0222376 | A1 | 9/2011 | Musy et al. | |

FOREIGN PATENT DOCUMENTS

| | | |
|---|---|---|
| CH | 24786 | 2/1903 |
| CH | 174430 | 1/1935 |
| CH | 295135 | 12/1953 |
| CH | 610465 | 4/1979 |
| CH | 699988 | 5/2010 |
| EP | 2 060 957 | 5/2009 |
| FR | 2 282 662 | 3/1976 |
| NL | 55356 | 10/1943 |

* cited by examiner

*Primary Examiner* — Sean Kayes
(74) *Attorney, Agent, or Firm* — Blank Rome LLP

(57) ABSTRACT

Drive member for timepiece movement comprising: a barrel comprising a drum mounted on an arbor; a main spring wound inside the barrel, and a core coaxial with and pivoting on the arbor; the exterior end of the spring being coupled to the drum and the interior end of the spring being coupled to the core; the exterior end of the spring is coupled to the drum by a first clamp that is pivot-mounted in the drum so that when the spring is unwound, the first clamp pivots in such a way as to hold the exterior turn of the first spring against the drum and when the spring is wound up, the first clamp pivots towards the center of the barrel to follow the exterior turn of the spring. The bending stresses in the spring are reduced.

16 Claims, 4 Drawing Sheets

DRIVE MEMBER FOR CLOCK MOVEMENT

TECHNICAL FIELD

The present invention relates to a drive member for clock, or timepiece, movement comprising one or several springs. More particularly, the present invention relates to a drive member in which the bending stresses in the spring are reduced and wherein the drive member can have a smaller volume as compared with a conventional drive member, whilst being capable of storing the same quantity of mechanical energy.

STATE OF THE ART

The spiral barrel spring is the member enabling the mechanical energy necessary for the operation of the watch to be stored. Generally, its geometric dimensions and the mechanical properties of the material it is composed of will determine the potential energy that the spiral barrel is capable of storing and the maximum torque it delivers. In the field of mechanical timepiece movements, it is known to replace the usual drive member comprising a single spring barrel by a group of two barrels coupled serially in order to accumulate a sufficiently ample potential energy to ensure a power reserve greater than the some 40 hours that are usual, without affecting the chronometric performances of the watch nor the performance of the wheelwork.

A detailed explanation of the functional characteristics of such a drive member can be found in patent CH610465, which provides as examples a superimposed arrangement and a juxtaposed arrangement of the barrels. In this patent, it is the superimposed arrangement that is chosen because the torque can be transmitted from one barrel to the other directly via a common arbor, which prevents space losses and output losses due to the setting wheel gear that is required in the juxtaposed arrangement. However, such a drive member suffers from a considerable height due to the superimposition of the barrels.

Using composite materials, such as a polymer reinforced with glass or other fiber for the manufacture of the mainspring makes it possible to obtain springs that are less vulnerable than the conventional metallic springs to stress fractures and, consequently, have a longer lifespan. Using such composite materials can require a dimensioning of the springs taking into account the specificities that differentiate these composite materials from the steels traditionally used. For example, a polymer reinforced with unidirectional glass fibers has a modulus of elasticity about four times lower than that of steel for a yield strength lower by about half. The dimensioning of the springs must also take into account the application modes of composite materials. Although steel laminating techniques do allow blade thicknesses smaller than one tenth of a millimeter, such limited dimensions are difficult to achieve with the target mechanical performance in the case of composite materials. For a constant volume and height of the spring, and for an equivalent quantity of energy stored, a greater thickness of the blade will result in an increase of the maximum torque delivered. Springs of composite material can furthermore exhibit a bending strength that is lower than that of metal springs.

BRIEF SUMMARY OF THE INVENTION

One aim of the present invention is to propose a drive member for timepiece movement that is free from the limitations of the known drive members.

Another aim of the invention is to propose a drive member according to the preamble of claim 1, wherein the bending stresses in the spring are reduced and wherein the drive member can have a reduced volume as compared to a conventional drive member, whilst being capable of storing the same quantity of mechanical energy.

According to the invention, these aims are achieved notably by means of a drive member for timepiece movement comprising:

a barrel comprising a drum mounted on an arbor so that it can rotate with the arbor about an axis when the drive member is wound up;

a main spring wound inside the barrel and able to be wound up around the arbor when the drive member is wound up, and a core coaxial with and pivoting on the arbor;

the exterior end of the spring being coupled to the drum and the interior end of the spring being coupled to the core;

the exterior end of the spring is coupled to the drum by a first clamp that is pivot-mounted in the drum so that when the spring is unwound, the first clamp pivots in such a way as to hold the exterior turn of the first spring against the drum and when the spring is wound up, the first clamp pivots towards the center of the barrel to follow the exterior turn of the spring.

The invention also relates to a method for assembling the drive member, comprising the steps of:

fastening the exterior end of the spring in the first clamp and fastening the interior end of the spring in the second clamp;

winding up the spring in an external mainspring winder and inserting the wound-up spring into the drum; and placing the first clamp into the drum and the second clamp on the arbor.

BRIEF DESCRIPTION OF THE FIGURES

Examples of embodiments of the invention are indicated in the description illustrated by the attached figures in which.

EXAMPLE(S) OF EMBODIMENTS OF THE INVENTION

Figure 1:
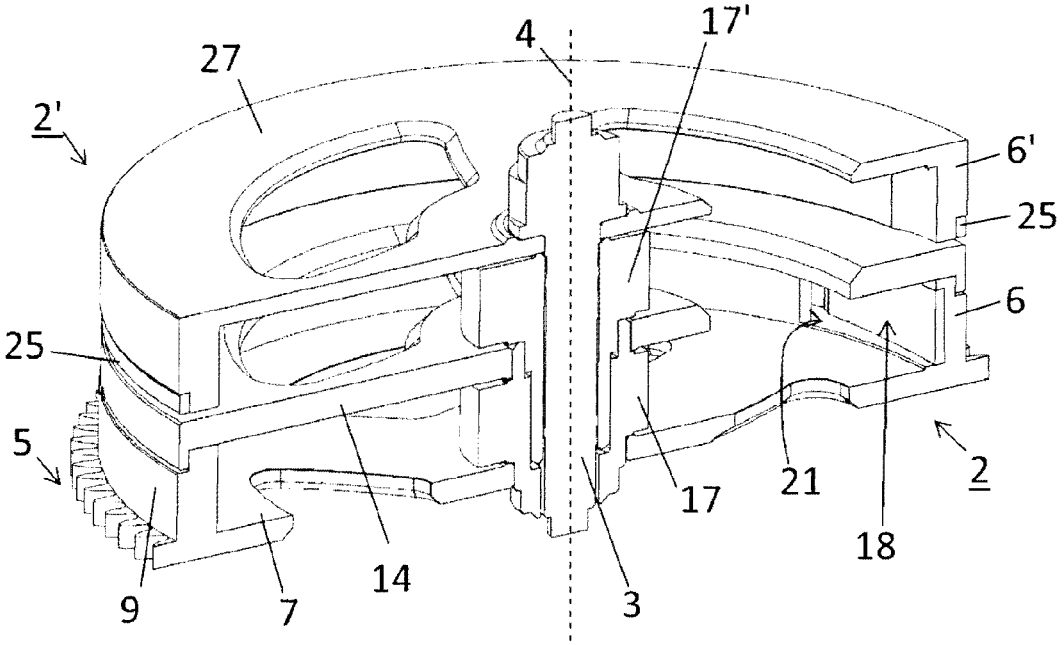
FIGS. 1 and 2 show a perspective view (FIG. 1) and a side view (FIG. 2) of a drive member comprising a barrel and a first and second mainspring, according to one embodiment.
Figure 2:
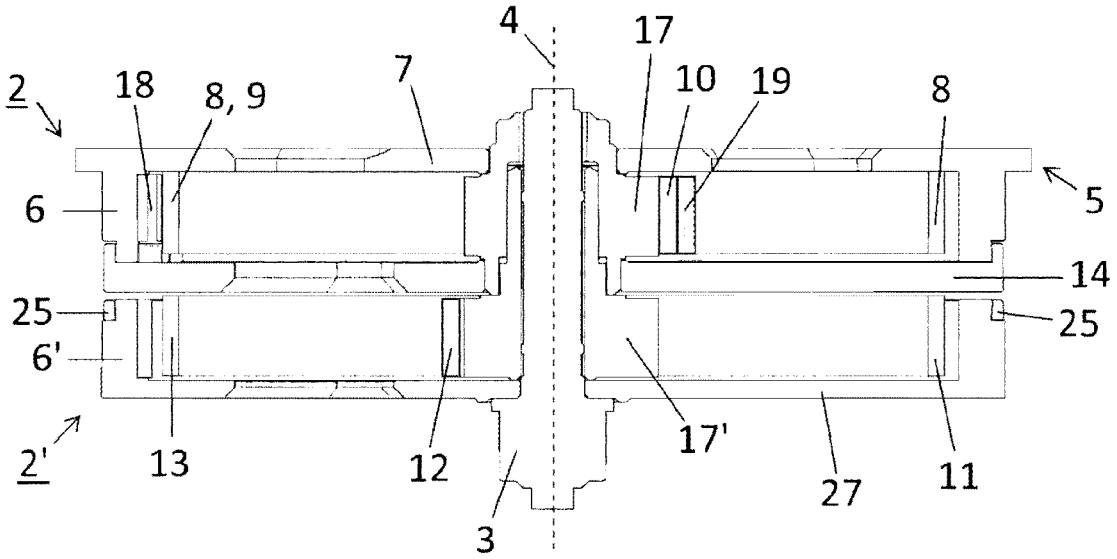

A drive member 1 is shown in perspective in FIG. 1 and from the side in FIG. 2 according to one embodiment. The drive member 1. The drive member 1 comprises a first barrel 2 and a second barrel 2' that are superimposed and mounted on a common arbor 3 to turn independently from one another about the axis 4 of the arbor. The first barrel 2 comprises a first external drum 6 capable of comprising an external toothing 5 and a bottom 7. A first core 17 is mounted coaxial with and pivoting on the arbor 3. The first barrel 2 further comprises a first mainspring 8 (of which only a single turn has been represented in the drawing of FIG. 2), spiral-wound, and whose exterior end 9 is coupled to the first drum 6 and whose interior end 10 is fastened to the first core 17. The structure of the second barrel 2' is analogous to that of the first, with a second external drum 6', a bottom 7 and a second core 17' mounted coaxial with and pivoting on the arbor 3. The second barrel 2' comprises a second spring 11 (of which also only a single turn has been represented in the drawing of FIG. 2), wound in the opposite direction to the first spring 8 and whose exterior end 13 is coupled to the second drum 6' and whose interior end 12 is fastened to the second core 17'. The two springs 8, 11 can have the same dimensions and characteristics. The first core 17 is integrally united with the second core 17'. The first spring 8 is thus serial with the second spring 11 through the first and second core 17, 17'. In such a configuration, the springs 8, 11 work in the same direction, with the first and second core 17, 17' serving as kinematic connection between the two springs.

Figure 3:
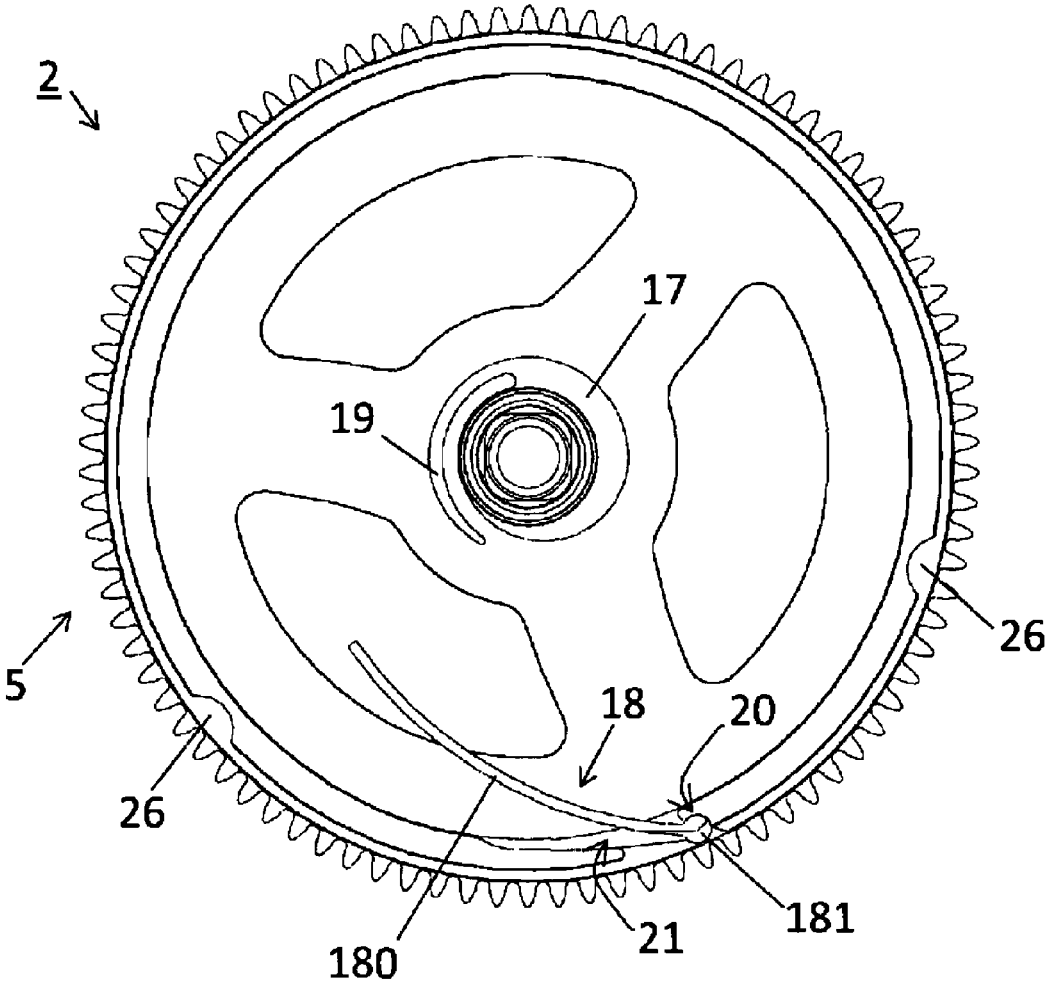
FIG. 3 represents a view from above of the barrel showing a first clamp and a core comprising a second clamp, according to one embodiment.
Figure 4:
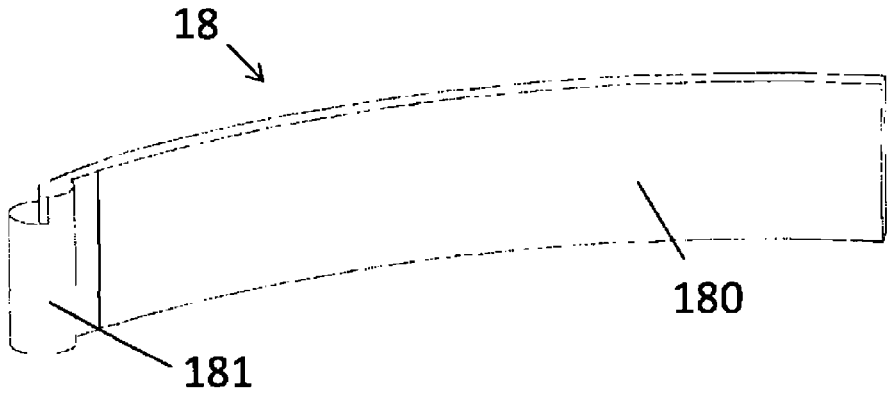
FIG. 4 illustrates the first clamp, according to one embodiment.

A plate 14 is placed between the two springs 8, 11, coaxial with them and the arbor 3. In the example of FIGS. 1 and 2, the first plate 14 has the shape of a disc with an outer diameter substantially equal to that of the drums 6 and 6'. The plate 14 is integrally united with one of the drums 6, 6' and with the arbor 3, so that one of the barrels 2, 2' turns together with the plate 14. The plate 14 can be made of a plastic material with a low coefficient of friction such as PTFE, but also of metal, possibly with an antifriction coating. In one embodiment, not represented, the drive member 1 can comprise another plate coaxial with the plate 14. In such a configuration, each of the plates can be integrally united with one of the drums 6, 6', so that each of the barrels 2, 2' turns together with one of the plates, FIG. 3 represents a view from above of the barrel 2 showing a first clamp 18 designed to fasten the exterior end 9 of the first spring 8 to the first drum 6, according to one embodiment. In a similar manner, the exterior end 13 of the second spring 11 is also fastened to the second drum 6' by such a first clamp 18 in this embodiment. FIG. 4 shows said first clamp 18 in isolated fashion. The first clamp 18 comprises a tongue 180 onto which is fastened the exterior end 9, 13, and a peg 181 designed to be inserted in a pivoting fashion into a boring 20 made in the thickness of the drum 6, 6'. The drum 6, 6' can also comprise a housing 21 into which at least one portion of the first clamp 18 is lodged when the spring 8, 11 is wound down and finds itself wound against the interior diameter of the drum 6, 6'. When the mainspring 8, 11 winds down, the position of the first clamp 18 in the housing 21 makes it possible to hold the outer turn (the turn on the side of the exterior end 9, 13) against the drum 6, 6' of the barrel 2, which ensures a more concentric development of the mainspring 8, 11 whilst working against the possible decentering of the turns of the spring 8, 11. When the spring 8 is totally wound up, the first clamp 18 pivots towards the center of the barrel 2 and accompanies the outer turn of the spring 8, 11, so as to not cause bending stresses. The spring 8, 11 can thus wind up to the end without risk of deterioration.

In one embodiment, an annular element 25 (see FIG. 8) is comprised at the periphery of the first and/or second drum 6, 6'. The annular element 25 has the function of limiting an axial displacement of the first clamp 18.

The first clamp 18 does not fulfill the role of a sliding clamp normally used in conventional drive members for fastening the exterior end of the spring. Such a sliding clamp enables the spring to slide with a certain angle in the barrel drum when the winding up has reached its maximum value. In order to address this deficiency, the drive member 1 can comprise a disconnectable crown (not represented) preventing the springs 8, 11 from being overstressed. Such a disconnectable crown makes it possible to limit the torque transmitted by a user when the watch is wound up manually. For example, in one embodiment (not represented), the disconnectable crown enables the torque to travel through a click comprising two gearings held by a return spring. If the torque to be transmitted is greater than the force of the return spring, the click opens and the torque is no longer transmitted.

Figure 5:
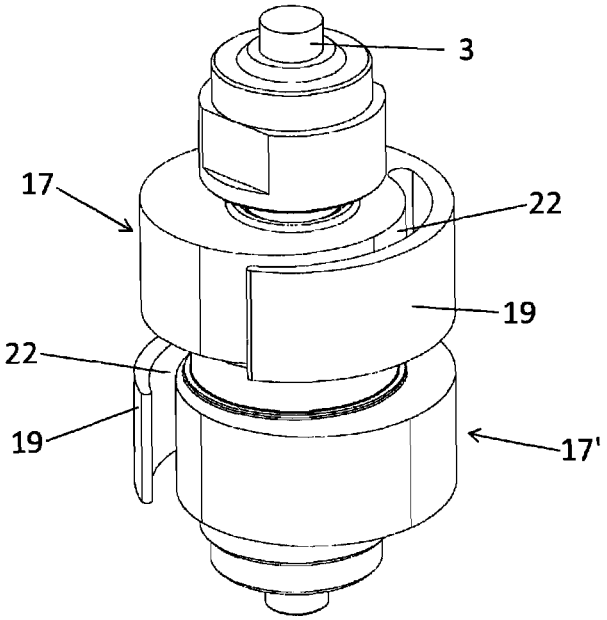
FIG. 5 illustrates the core comprising a first core and a second core, each with the second clamp, according to one embodiment.

FIG. 5 illustrates the first and second cores 17, 17' mounted on the arbor of the barrel 3, according to one embodiment. Each of the cores 17 and 17' comprises a second clamp 19 designed to fasten the interior end 10, 12 of the first and second spring 8, 11 respectively onto the first and second core 17, 17'. In the example of FIG. 5, said second clamp 19 takes the shape of a blade extending at the periphery of the core 17, 17' and having a radius essentially equal to the start radius of the Archimedes spiral. The interior end 10 of the first and second spring 8, 11 (not visible in FIG. 5) is inserted in a slit 22 formed between the second clamp 19 and the core 17, 17'. In a preferred manner, the second clamp 19 is formed integrally with the core 17, 17', for example by overmolding onto the core. The second clamp 19 thus accompanies the inner turn of the spring 8, 11 on a controlled diameter. This arrangement enables the spring 8, 11 to work essentially in traction and to make up for the tangential work when the barrel 2 is wound up. Fastening the exterior end 9, 12 onto the first clamp 18 as well as the interior end 10, 13 onto the second clamp 19 can be done by gluing, soldering, by means of a mechanical fastener such as a hook, dovetail or any other suitable attachment means.

Figure 6:
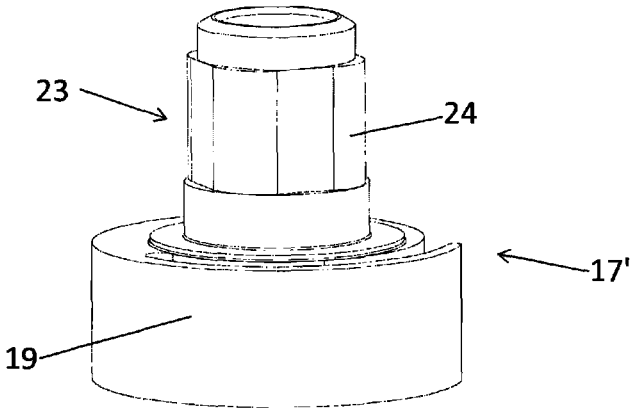
FIG. 6 shows the first core, according to one embodiment.

FIG. 6 shows the second core 17' according to an embodiment comprising a cannon 23 on which the first core 17 can be driven. In the example illustrated in FIG. 6, the cannon 23 comprises flutings 24 to enable the second core 17' to be integrally united in rotation with the first core 17. One advantage in having the first and second core 17, 17' manufactured in two parts is to simplify the assembly of the drive member 1.

In one embodiment, a method for assembling the drive member 1 comprises the steps of:

fastening the exterior end 9, 12 of the spring 8, 11 in the first clamp 18 and to fasten the interior end 10, 13 of the spring 8, 11 in the second clamp 19;

winding up the spring 8, 11 in an external mainspring winder (not represented);

inserting the wound-up spring 8, 11 fastened on the first and second clamp 18, 19 into the barrel 2, 2' by placing the first clamp 18 into the drum 6, 6' and the second clamp 19, 19' on the arbor 3.

Figure 8:
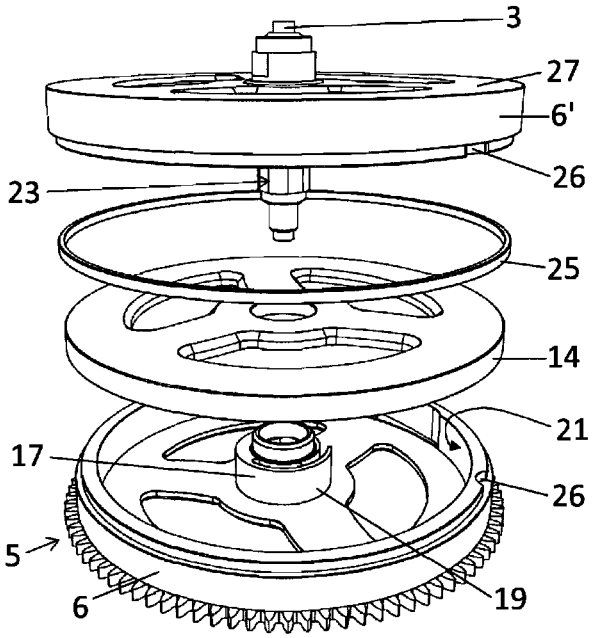
FIG. 8 shows an exploded view of the drive member according to one embodiment.

FIG. 8 shows an exploded view of the drive member 1 according to one embodiment. In this figure, the springs 8, 11 and the first clamp 18 of each of the latter are not visible. It is however possible to see the first core 17 that is to be driven onto the cannon 23 of the second core 17' during the assembly of the first drum 6, of the plate 14 and of the second drum 6'. More particularly, the first clamp 18 of each spring can be placed in the corresponding barrel 2, 2' by inserting the peg 181 into the boring 20 provided in the drum 6, 6'. An angular positioning of the springs 8, 11 in the first and second barrel 2, 2' is ensured by the mainspring winder and one or several notches 26 made on the drums 6, 6'. The first clamp 18 can be held in position by the plate 14 and by the annular element 25 and the bottom 27 of the drum 6, 6' of the barrel. In the case where the drive member 1 comprises the first and second spring 8, 11, the wound up springs 8, 11 could be inserted sequentially into the first and second barrel 2, 2'. For example, the first and second clamp 18, 19 of the first spring 8 are placed respectively on the first drum 6 and the arbor 3, and the first and second clamp 18, 19 of the second spring 11 are placed respectively on the second drum 6' and the arbor 3.

In one embodiment, not represented, the first core 17 is formed integrally with the second core 17', for example the first and second core 17, 17' are formed of a single tubular element turning about the arbor 3. In this case, the two springs 8, 11 are inserted simultaneously into the first and the second barrel 2, 2'.

It is obvious that the present invention is not limited to the embodiment that has just been described and that various modifications and simple variants can be conceived of by the one skilled in the art without falling outside the scope of the present invention.

Figure 7:
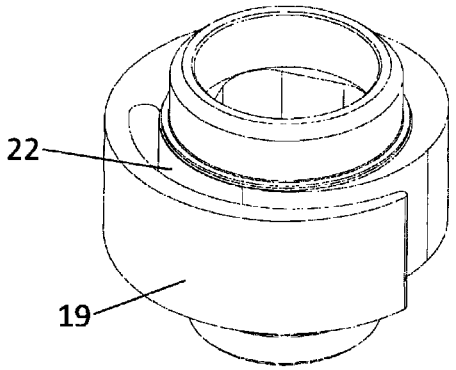
FIG. 7 represents the core according to another embodiment.

In one embodiment, not represented, the drive member 1 comprises only one barrel and one mainspring. In such a configuration, the exterior end of the spring can be coupled to the drum by means of the first clamp 18, and the interior end of the spring can be fastened to the core by means of the second clamp 19. FIG. 7 illustrates an example of the core 17 with the second clamp 19 for this configuration of the drive member 1.

The first and second spring 8, 11 can be made of metal or any other appropriate material. In a preferred manner, the first and second spring 8, 11 are made of a composite material. "Composite material" is understood here to be a polymer reinforced with long fibers, such as glass or other fibers. The fibers are preferably oriented in a unidirectional manner in the polymeric matrix. Such springs made of the composite material can be less vulnerable than the conventional metallic springs to stress fractures and, consequently, have a longer lifespan. Such composite springs are described in more detail in patent application EP2455820 of the present applicant.

In fact, mainsprings made of composite materials are more likely to be damaged by bending stresses, but the pivoting first clamp 18 advantageously enables the spring 8, 1 to be held in the barrel 2, 2' so as to minimize the bending stresses. The second clamp 19 also enables the tangential forces on the spring 8, 11 to be minimized. A spring 8, 11 of composite material can thus be held with a lower degradation than in a conventional drive member. The drive member of the invention also has a reduced volume as compared with a conventional drive member, whilst being capable of storing the same quantity of mechanical energy. Indeed, the composite material spring 8, 11 has a curving radius that is greater than that of a metallic spring and can thus be wound up more tightly around the core 17, 17'. The latter can also have a smaller diameter than the usual diameter in a conventional core. Furthermore, when the drive member is wound down, the first clamp 18 is pivoted in the housing 21, which allows the outer turn of the spring 8, 11 to be held against the drum 6, 6', which allows an additional reduction of the volume of the barrel 2, 2'.

REFERENCE NUMBERS USED IN THE FIGURES

1 drive member
2 first barrel
2' second barrel
3 barrel arbor
4 axis of the arbor
5 external toothing
6 drum
7 barrel bottom
8 first mainspring
9 exterior end of the first spring
10 interior end of the first spring
11 second mainspring
12 interior end of the second spring
13 exterior end of the second spring
14 first plate
15 periphery of the plate, edge
16 center of the plate
17 first core
17' second core
18 first clamp
180 tongue
181 peg
19 second clamp
20 boring
21 housing
22 slit
23 cannon
24 fluting
25 annular element
26 notches
27 bottom of the drum

The invention claimed is:

1. Drive member for timepiece movement comprising:

a barrel comprising a drum mounted on an arbor so that it can rotate with the arbor about an axis when the drive member is wound up;

a main spring wound inside the barrel and able to be wound up around the arbor when the drive member is wound up, and a core coaxial with and pivoting on the arbor;

the exterior end of the spring being coupled to the drum and the interior end of the spring being coupled to the core;

wherein the exterior end of the spring is coupled to the drum by a first clamp that is pivot-mounted in the drum so that when the spring is unwound, the first clamp pivots in such a way as to hold the exterior turn of the first spring against the drum and when the spring is wound up, the first clamp pivots towards the center of the barrel to follow the exterior turn of the spring.

2. Drive member according to claim 1, wherein the first clamp comprises a portion onto which is fastened the exterior end of the spring, and a peg pivoting in the drum.

3. Drive member according to claim 2, wherein the peg is inserted in a pivoting fashion into a boring made in the thickness of the drum.

4. Drive member according to claim 1, wherein the core comprises a second clamp designed to fasten the interior end of the spring to the core.

5. Drive member according to claim 4, wherein said second clamp comprises a blade extending at the periphery of the core, forming a slit between the blade and the core designed for the insertion of the interior end of the spring.

6. Drive member according to claim 5, wherein the blade has a radius essentially equal to the start radius of the Archimedes spiral.

7. Drive member according to claim 4, wherein the second clamp is formed integrally with the core.

8. Drive member according to claim 1, wherein said barrel comprises a first barrel and a second barrel superimposed onto the first barrel; wherein the first barrel comprises a first drum and the second barrel comprises a second drum; and wherein said mainspring comprises a first spring and a second spring superimposed over and coaxial with the first spring; wherein the exterior end of the first spring is fastened respectively to the first drum and the exterior end of the second spring is fastened to the second drum.

9. Drive member according to claim 8, wherein said core comprises a first core and a second core integrally united with the first core; and wherein the interior end of the first spring is fastened to the first core and the interior end of the second spring is fastened to the second core, so that the two springs wind up simultaneously about the arbor when the drive member is wound up.

10. Drive member according to claim 8, wherein the first core comprises a cannon onto which the second core can be driven.

11. Drive member according to claim 8, further comprising a plate mounted between the two springs and coaxial with the latter.

12. Drive member according to claim 11, wherein the plate is mounted integrally in rotation with the arbor.

13. Drive member according to one of the claim 8, wherein the first spring is wound in the opposite direction to the second spring so that the first spring is serial with the second spring by means of the first and second core.

14. Drive member according to claim 8, further comprising an annular element comprised at the periphery of said drum so as to limit the axial displacement of the first clamp.

15. Drive member according to claim 1, wherein said mainspring is made of a composite material.

16. Method for assembling a drive member comprising a barrel comprising a drum mounted on an arbor so that it can rotate with the arbor about an axis when the drive member is wound up; a main spring wound inside the barrel and able to be wound up around the arbor when the drive member is wound up; and a core coaxial with and pivoting on the arbor; the exterior end of the spring being coupled to the drum by a first clamp that is pivot-mounted in the drum; and the interior end of the spring being coupled to the core; and wherein the core comprises a second clamp designed to fasten the interior end of the spring to the core; the method comprising the steps of:

fastening the exterior end of the spring in the first clamp and fastening the interior end of the spring in the second clamp;

winding up the spring in an external mainspring winder and inserting the wound-up spring into the drum; and placing the first clamp into the drum and the second clamp on the arbor.

* * * * *